United States Patent [19]

Emmert

[11] 4,362,346

[45] Dec. 7, 1982

[54] DISHWASHER RACK MOUNTING TRACK

[75] Inventor: Clayton F. Emmert, Newton, Iowa

[73] Assignee: The Maytag Company, Newton, Iowa

[21] Appl. No.: 195,673

[22] Filed: Oct. 9, 1980

[51] Int. Cl.[3] ..... A47B 88/00; F16C 17/00

[52] U.S. Cl. ..... 312/311; 312/339; 308/3.8

[58] Field of Search ..... 312/311, 339, 333, 334; 308/3.6, 3.8

[56] References Cited

U.S. PATENT DOCUMENTS

| | | | |
|---|---|---|---|
| 2,750,052 | 6/1956 | Brown et al. | 312/339 |
| 3,347,613 | 10/1967 | Krzewina | 312/339 |
| 3,472,573 | 10/1969 | Geiger | 312/311 |
| 3,488,097 | 1/1970 | Fall | 312/339 |
| 3,701,577 | 10/1972 | Fischer | 312/339 |
| 3,906,967 | 9/1975 | Bergeson | 134/104 |
| 3,912,341 | 10/1975 | Stein | 308/3.8 |
| 4,072,375 | 2/1978 | Boone | 308/3.6 |

FOREIGN PATENT DOCUMENTS

| | | | |
|---|---|---|---|
| 561719 | 11/1957 | Belgium | 312/339 |
| 548269 | 1/1923 | France . | |
| 548474 | 1/1923 | France | 312/339 |
| 620460 | 3/1949 | United Kingdom | 312/339 |
| 659534 | 10/1951 | United Kingdom | 308/3.8 |

*Primary Examiner*—Victor N. Sakran

*Attorney, Agent, or Firm*—Richard L. Ward

[57] ABSTRACT

A one-piece unitary track member is provided which movably supports a rack within the washing chamber of a dishwashing apparatus. The track is formed from a single piece of sheet metal and includes a pair of substantially vertically aligned oppositely opening guideways for receiving rollers associated with the rack and with the sidewall of the washing chamber. The guideways include upper and lower flanges for retaining the rollers within the guideways with one of the flanges of each guideway formed of a double thickness of sheet metal folded back on itself.

11 Claims, 3 Drawing Figures

DISHWASHER RACK MOUNTING TRACK

BACKGROUND OF THE INVENTION

This invention relates generally to the field of dishwashing machines and more particularly to providing an improved unitary track for movably supporting a rack within the washing chamber.

In the design of front loading dishwashers it is common practice to provide at least two racks for supporting items to be washed. A lower rack is usually provided which will roll out onto the dishwasher door when the door is in the open posture. The upper rack is generally provided with some sort of rail or track mechanism which will support the rack while allowing it to extend out of the washing chamber for loading and unloading.

One track which has been disclosed in U.S. Pat. No. 3,472,573 utilizes a one-piece construction which includes two pairs of opposed curved beads. The rack rollers are captured between a first pair of beads and the tub rollers are captured between a second pair of beads. In this arrangement the rack and tub rollers are laterally offset from each other and the roller surfaces are shaped to conform to the curved bead surfaces.

Still another track is disclosed in U.S. Pat. No. 3,347,613 which includes a plurality of rollers mounted on the inside walls of the washing chamber with pairs of rollers spaced one above the other. An elliptically shaped track is secured to each side of the rack and the tracks are supported between the pairs of tub mounted rollers for movement of the rack-track assembly in and out of the washing chamber.

A track system for a desk or cabinet is disclosed in Belgium Pat. No. 561,719 which is of a one-piece construction but does not include flanges to totally retain the rollers mounted on the drawer or cabinet and does not show flanges formed by a double layer of sheet metal folded back on itself.

SUMMARY OF THE INVENTION

It is therefore an object of the instant invention to provide an improved rack mounting track member for a dishwashing apparatus.

It is a further object of the instant invention to provide a unitary one-piece track member with oppositely opening roller retaining guideways having double metal thickness retaining flanges and spaced vertically one above the other to retain rack and tub mounted rollers aligned in a substantially vertical plane.

Briefly, the instant invention achieves these objects in a horizontally elongated track for movably supporting a rack in a dishwashing apparatus and formed of a single unitary piece of sheet metal. The track includes a pair of oppositely facing C-shaped channels generally aligned one above the other and each defined by upper and lower substantially horizontal legs connected by a generally vertical wall with the vertical wall of a first channel being laterally and vertically offset from the vertical wall of the second channel. The lower leg of the upper channel and the upper leg of the lower channel is a common element and has an upwardly extending flange on the open side opposite the first vertical wall and a downwardly extending flange on the open side opposite the second vertical wall. The flanges are each formed by a double layer of sheet metal folded back on itself as an integral part of the unitary piece of sheet metal. The channels thus define a pair of oppositely opening guideways substantially aligned one above the other.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
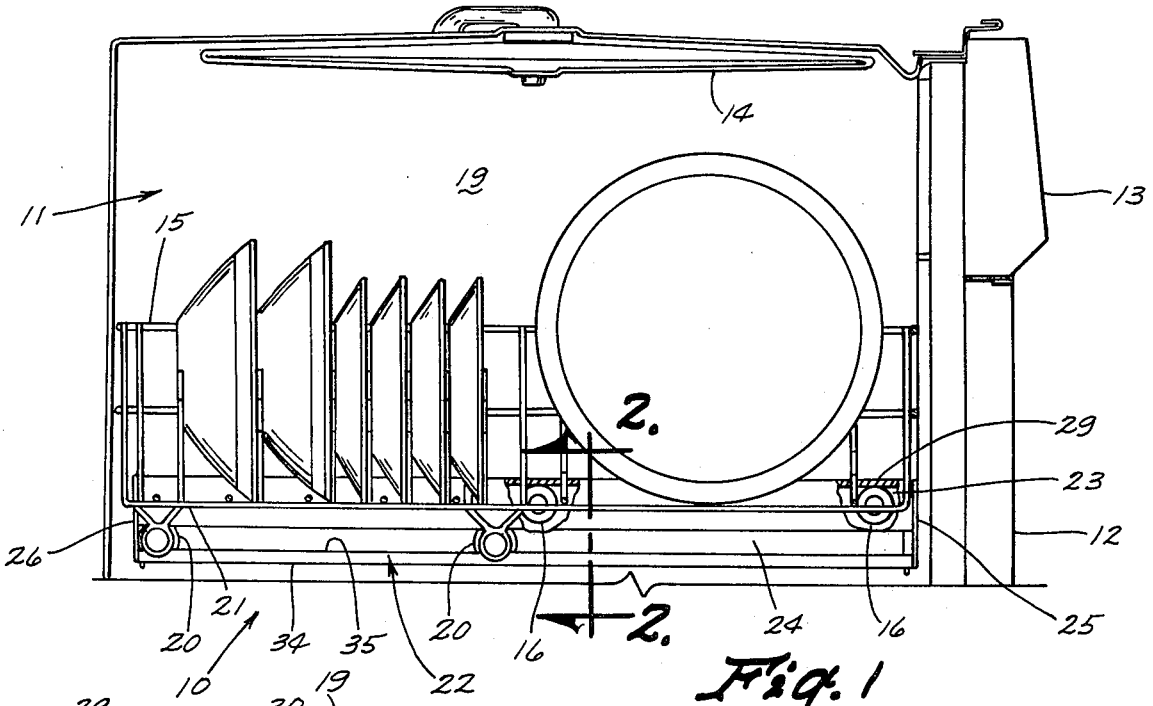
FIG. 1 is a partial section view of the upper portion of a dishwashing apparatus incorporating the instant invention.

There is shown generally in FIG. 1 the upper portion of a dishwashing apparatus 10. The dishwashing apparatus 10 includes a tub forming a washing chamber 11 and a door 12 for providing access to the washing chamber 11. The door 12 includes a control panel 13 for housing a timer and various other control elements (not shown) operable for controlling the dishwashing apparatus 10 through a prescribed cycle of operations including the washing, rinsing, and drying of dishes and silverware.

Located within the washing chamber 11 are racks or baskets for loading dishes and silverware to be washed. The top wash arm 14 shown in FIG. 1 directs a portion of the washing liquid downwardly into the racks and baskets and a bottom wash arm (not shown) directs a portion of the washing liquid upwardly into the racks and baskets. The combined washing liquid thus completely engulfs the racks and baskets and provides vigorous washing action to the articles contained therein. The dishwashing apparatus 10 as partially shown in FIG. 1 is further disclosed in U.S. Pat. No. 3,906,967 issued Sept. 23, 1975 to Richard P. Bergeson and assigned to the assignee of the instant invention.

Figure 2:
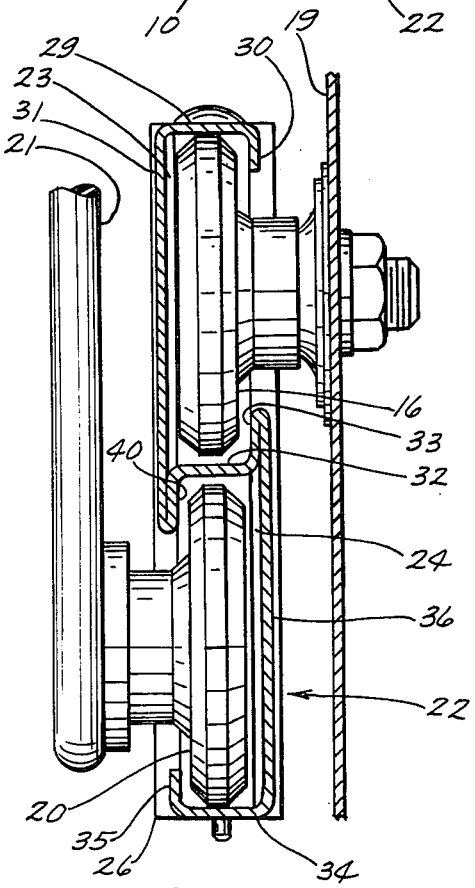
FIG. 2 is a partial section view taken through a track member generally along lines 2—2 of FIG. 1.

As best shown in FIGS. 1 and 2, the upper rack 15 of the dishwashing apparatus 10 is supported within the washing chamber 11 through a first pair of rollers 16 mounted on each side wall 19 of the washing chamber 11 and a second pair of rollers 20 mounted on each side portion 21 of the upper rack 15. A horizontally elongated track 22 is located at each side of the washing chamber 11 between each side portion 21 of the upper rack 15 and each side wall 19. Each track includes upper and lower guideways or channels 23 and 24 for receiving side wall mounted rollers 16 and rack mounted rollers 20, respectively. The rollers 16 and 20 each engage with and are movable in the track guideways or channels 23 and 24 to allow the upper rack 15 to be moved in and out of the washing chamber 11 for the loading or unloading of dishes. Specifically, when the dishwasher door 12 is open, the upper rack 15 may be pulled out by the operator and will roll on the rack mounted rollers 20 in the lower guideways 24 of the tracks 22 until the front rack mounted rollers 20 contact a pair of stop members 25 which close the front opening of the guideways 23 and 24 of the track 22. Outward movement of the upper rack 15 will continue with the track 22 moving upon the wall mounted rollers 16 in the upper guideways 23 until the rollers 16 contact a pair of rear stop members 26. The upper rack 15 may now be loaded or unloaded and then returned to the inside of the washing chamber 11.

As further shown in FIGS. 1 and 2, each of the tracks 22 within which the side wall and rack mounted rollers 16 and 20 are guided is a horizontally elongated one-piece sheet metal structure which extends substantially the full front to rear depth of the washing chamber 11. The tracks 22 are formed by a metal rolling process to achieve the unique one-piece track member to be described herein. FIG. 2 shows one of the horizontally elongated tracks 22 in cross section and also shows the side wall mounted rollers 16 generally vertically aligned above the rack mounted rollers 20 when received in the guideways or channels 23 and 24 of the tracks 22. The tracks 22 as formed provide a pair of oppositely opening guideways or channels 23 and 24 in the general configuration of a pair of C-shaped channels mounted one above the other.

The upper guideway or channel 23 of the one-piece track 22 shown in FIG. 2 includes a roller engaging upper horizontal leg 29 having a downwardly turned flange 30 at the edge of the horizontal leg 29 adjacent the side wall 19 of the washing chamber 11. The opposite edge of the upper horizontal leg 29 continues in a downwardly extending vertical wall member 31 generally perpendicular to the upper horizontal leg 29 and substantially parallel to the downwardly turned flange 30. The upper guideway 23 further includes a lower horizontal leg 32 which is generally perpendicular to the vertical wall member 31. The lower horizontal leg 32 has an upwardly turned flange 33 at the edge of the leg 32 which is generally parallel to the vertical wall member 31 and adjacent the side wall 19 of the washing chamber 11. The inside edge of flanges 30 and 35 is vertically aligned to form one side of the upper guideway or channel 23.

The lower guideway or channel 24 of the one-piece track 22 includes a roller supporting lower horizontal leg 34 having an upwardly turned flange 35 at the edge adjacent the upper rack 15. The opposite edge of the lower horizontal leg 34 continues in a vertical wall member 36 which is laterally offset from the vertical wall member 31 of the upper guideway 23 and extends upwardly to the outer edge of the upwardly extending flange 33 of the upper guideway 23. The vertical wall member 36 is generally perpendicular to the lower horizontal leg 34 and substantially parallel to the upwardly extending flange 35. The lower guideway 24 further includes as an upper horizontal leg, the horizontal leg 32. The horizontal leg 32 includes a downwardly turned flange 40 juxtaposed to the inner edge of the vertical wall member 31 of the upper guideway 23. The inside edge of flanges 35 and 40 is vertically aligned to form one side of the lower guideway or channel 24.

The downwardly turned flange 40 of the lower guideway 24 and the upwardly turned flange 33 of the upper guideway 23 are both formed of double thicknesses of sheet metal. As best shown in FIG. 2, the lower portion of the vertical wall member 31 of the upper guideway 23 is folded back on itself to form the downwardly turned flange 40 of the lower guideway 24. The sheet metal is formed generally perpendicular to the downwardly turned flange 40 to become the common horizontal leg 32 and is returned to a generally vertical orientation to form the upwardly turned flange 33 of the upper guideway 23. The sheet metal is then folded back on itself and extends downwardly to become the laterally offset vertical wall member 36 of the lower guideway 24.

The side wall mounted rollers 16 engage with and track upon the upper horizontal leg 29 of the upper guideway 23 and the rack mounted rollers 20 engage with and track upon the lower horizontal leg 34 of the lower guideway 24. The flanges of each guideway 23 and 24 retain the rollers 16 and 20 for movement within the guideways 23 and 24 upon the upper and lower horizontal legs 29 and 34 respectively.

Figure 3:
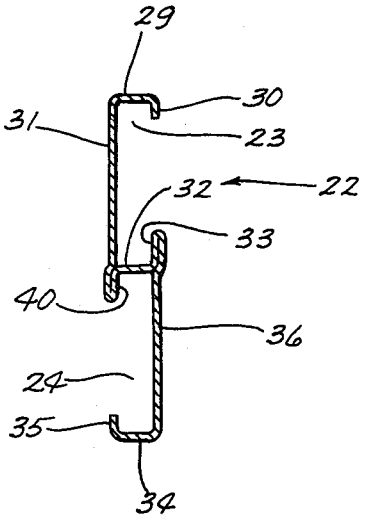
FIG. 3 is a sectional view of a track member showing an alternate embodiment of the track construction.

FIG. 3 shows an alternate embodiment of the center portion of the track 22. In this embodiment, the upwardly turned flange 33 of the upper guideway 23 and the downwardly turned flange 40 of the lower guideway 24 are each outwardly offset by a metal thickness. This offset arrangement allows the side wall and rack rollers 16 and 20 to be substantially precisely aligned one above the other.

Prior to invention of the construction shown in FIGS. 2 and 3, a three piece track construction was utilized by the assignee. The three piece construction included a main body having an S-shaped cross-sectional configuration similar to that shown in the Belgium Pat. No. 561,719 cited herein. In this previous construction a sheet metal strip was spot welded to each side of the main body to form flanges corresponding generally to the central flanges 33 and 40 which are formed by the folded back double thickness portions of the instant invention.

The three piece welded construction presented several problems which are solved by the single piece construction shown herein. Because the three pieces of the assembly were individually fabricated and then assembled there was a great deal of material handling involved in the three piece construction. The sheet metal strips presented edges which would contact and scuff the vinyl covered rack wires resulting in oxidation of the bared wires. Also, the spot welds which join the pieces were more susceptible to undesirable oxidation than the parent metal.

In addition to the elimination of the indicated problems the track of the instant invention provided positive advantages. The generally vertical alignment of the guideways 23 and 24 one on top of the other provides a compact track 22 arrangement which minimizes lost space at each side wall and allows the rack 15 to be of maximum capacity. The vertical channel or guideway alignment allows the rollers 16 and 20 of both the rack 15 and the side wall 19 to be substantially vertically aligned to reduce or prevent twisting of the track 22 as would be present if the rollers 16 and 20 were laterally offset from each other. Forming the track 22 from a single piece of sheet metal by folding the metal back on itself enables a thinner gage of sheet metal to be utilized due to the strength and rigidity gained in the double wall flanges. The use of the thinner sheet metal results in a track 22 which is light in weight and low in cost.

It is thus seen that the instant invention defines an improved track member 22 for supporting a rack 15 within the washing chamber 11 of a dishwashing apparatus 10. Each track member 22 provides a pair of substantially vertically aligned oppositely opening guideways 23 and 24 formed from a single sheet of metal with one flange of each guideway formed of a double thickness material.

In the drawings and specification there is set forth a preferred embodiment of the invention and although specific terms are employed these are used in a generic and descriptive sense only and not for purposes of limitation. Changes in the form and the proportion of parts as well as the substitution of equivalents are contemplated as circumstances may suggest or render expedient without departing from the spirit or scope of the invention as defined in the following claims.

I claim:

1. A horizontally elongated track for movably supporting a rack in a dishwashing apparatus and formed of a single unitary piece of sheet metal comprising, a pair of oppositely facing C-shaped channels generally aligned one above the other and each defined by upper and lower substantially horizontal legs connected by a generally vertical wall with the vertical wall of a first channel being laterally and vertically offset from the vertical wall of the second channel, the lower leg of the upper channel and the upper leg of the lower channel being a common element and having an upwardly extending flange on the open side opposite the first vertical wall and a downwardly extending flange on the open side opposite the second vertical wall, said flanges each being formed by a double layer of sheet metal formed back on itself as an integral part of said unitary piece of sheet metal, said channels defining a pair of oppositely opening guideways substantially aligned one above the other.

2. A horizontally elongated track as defined in claim 1 and further including a downwardly extending flange associated with said upper horizontal leg of said upper channel and substantially aligned with said upwardly extending flange of said lower leg of said upper channel.

3. A horizontally elongated track as defined in claim 1 and further including an upwardly extending flange associated with said lower horizontal leg of said lower channel and substantially aligned with said downwardly extending flange of said upper leg of said lower channel.

4. A horizontally elongated track as defined in claim 1 wherein at least one of said generally vertical walls includes means effective for substantially precisely aligning said guideways one above the other.

5. A horizontally elongated track including a pair of oppositely facing C-shaped channels substantially aligned one above the other for movably supporting a rack in a dishwashing apparatus and formed of a single unitary piece of sheet metal, comprising in cross section: an upper generally horizontal leg having a downwardly extending flange at one edge; a first wall extending downwardly from the other edge of said upper leg and having a length exceeding the height of the upper channel and folded back on itself to form a downwardly extending double wall central flange; a central leg for said channels extending horizontally from the folded back portion of said first wall; an upwardly extending double wall central flange connected to the other edge of said central leg aligned with said downwardly extending upper flange and comprising a section of sheet metal folded back on itself; second wall means continuing downwardly from said folded back section; and a lower generally horizontal leg connected to said second wall and having an upwardly extending flange substantially aligned with said downwardly extending central flange.

6. An improved rack mounting system for a dishwashing apparatus having a washing chamber with side walls and open at the front and further having a door for closing the open front, the combination comprising: a rack disposed in said washing chamber and including opposite side portions juxtaposed to said chamber side walls; a pair of rollers mounted on each of said chamber side walls; a pair of rollers mounted on each rack side portion; and a pair of elongated tracks with one of said tracks disposed between each of said chamber side walls and the adjacent one of said rack side portions, each of said tracks formed from a single unitary piece of sheet metal and defining a pair of oppositely opening flanged channels, a first of said channels opening outwardly toward said chamber side walls to receive said pair of side wall mounted rollers and having lower and upper retaining flanges, a second of said channels opening inwardly toward said rack to receive said pair of side portion mounted rollers and having lower and upper retaining flanges, said lower flange of said first channel and said upper flange of said second channel comprising a double layer of sheet metal folded back on itself, said rollers being movable in said channels whereby said rack may be pulled from said chamber while supported by said track.

7. A rack mounting system as defined in claim 6 wherein the side of each of said channels opposite said flange is closed by a vertical wall member and said double layer flanges are offset relative to said vertical wall members to maintain vertical alignment of said rollers.

8. A rack mounting system as defined in claim 6 wherein said track channels each include lower and upper horizontal leg portions.

9. A rack mounting system as defined in claim 8 wherein said chamber side wall mounted rollers are engageable with said upper leg portion of said first channel and said rack side portion mounted rollers are supported on said lower leg portion of said second channel.

10. An improved rack mounting system for a dishwashing apparatus having a washing chamber with side walls and open at the front and further having a door for closing the open front, the combination comprising: a rack disposed in said washing chamber and including opposite side portions juxtaposed to said chamber side walls; a pair of rollers mounted on each of said chamber side walls; a pair of rollers mounted on each rack side portion; and a pair of elongated tracks with one of said tracks disposed between each of said chamber side walls and the adjacent one of said rack side portions, each of said tracks formed from a single unitary piece of sheet metal and defining a pair of oppositely opening flanged channels substantially vertically aligned one above the other, said channels each including lower and upper retaining flanges and lower and upper horizontal leg portions with the lower horizontal leg portion of the upper channel and the upper horizontal leg portion of the lower channel being a common member and with the side of each of said channels opposite said flanges closed by vertical wall members connecting said lower and upper leg portions, a first of said channels opening outwardly toward said chamber side walls to receive said pair of side wall mounted rollers, a second of said channels opening inwardly toward said rack to receive said pair of side portion mounted rollers, said lower flange of said first channel and said upper flange of said second channel comprising a double layer of sheet metal folded back on itself, said rollers being movable in said channels whereby said rack may be pulled from said chamber while supported by said tracks.

11. A rack mounting system as defined in claim 10 wherein said double layer flanges are offset relative to said vertical wall members to maintain vertical alignment of said rollers.

* * * * *